US009598932B2

(12) United States Patent
Martin et al.

(10) Patent No.: US 9,598,932 B2
(45) Date of Patent: Mar. 21, 2017

(54) FLOW CONTROL SYSTEM

(76) Inventors: David Glen Martin, Aberdeen (GB); Roland Marcel Van Dort, Stonehaven (GB)

( * ) Notice: Subject to any disclaimer, the term of this patent is extended or adjusted under 35 U.S.C. 154(b) by 529 days.

(21) Appl. No.: 14/122,056

(22) PCT Filed: May 24, 2012

(86) PCT No.: PCT/GB2012/051162

§ 371 (c)(1),
(2), (4) Date: Mar. 11, 2014

(87) PCT Pub. No.: WO2012/160377

PCT Pub. Date: Nov. 29, 2012

(65) Prior Publication Data

US 2014/0196888 A1 Jul. 17, 2014

(30) Foreign Application Priority Data

May 24, 2011 (GB) ..... 1108710.3

(51) Int. Cl.

| | |
|---|---|
| ***E21B 34/14*** | (2006.01) |
| ***E21B 23/08*** | (2006.01) |
| *E21B 33/12* | (2006.01) |
| *E21B 34/00* | (2006.01) |

(52) U.S. Cl.

CPC ..... *E21B 34/14* (2013.01); *E21B 23/08* (2013.01); *E21B 2034/007* (2013.01)

(58) Field of Classification Search

CPC ..... E21B 23/08; E21B 34/14; E21B 33/126; E21B 2034/007

See application file for complete search history.

(56) References Cited

U.S. PATENT DOCUMENTS

| | | | | |
|---|---|---|---|---|
| 3,263,752 | A * | 8/1966 | Conrad | E21B 34/14 166/154 |
| 4,429,747 | A | 2/1984 | Williamson, Jr. | |
| 6,343,649 | B1 * | 2/2002 | Beck | E21B 31/18 166/250.01 |
| 2006/0124310 | A1 | 6/2006 | Lopez de Cardenas | |
| 2007/0221373 | A1 | 9/2007 | Murray | |
| 2013/0206402 | A1 * | 8/2013 | Coon | E21B 23/08 166/255.1 |

FOREIGN PATENT DOCUMENTS

WO WO 2010/007403 1/2010

OTHER PUBLICATIONS

International Search Report, Dec. 12, 2013, for PCT/GB2012/051162.

* cited by examiner

*Primary Examiner* — Cathleen Hutchins
(74) *Attorney, Agent, or Firm* — Cantor Colburn LLP

(57) ABSTRACT

A downhole flow control apparatus comprising: at least one tubular body (1) locatable at a zone of a well, the tubular body (1) having a longitudinal through bore and one or more transverse ports (5*a*, 5*b*) and a port covering device (3) which, in use, is movable from a lower position in which the or each port is covered to an upper position in which the or each port is open; and at least one plugging device (6) which is operable to travel downhole from the surface to locate within and seal the through bore of the tubular body, the plugging device including moving means (10) to cause the port covering device (3) to move from the lower position to the upper position thus allowing fluid communication between the through bore and the or each port (5*a*, 5*b*).

19 Claims, 7 Drawing Sheets

FLOW CONTROL SYSTEM

CROSS-REFERENCE TO RELATED APPLICATIONS

The present application is a 35 U.S.C. Section 371 national stage filing of International Patent Application No. PCT/GB2012/051162, filed 24 May 2012, and through which priority is claimed to United Kingdom patent application GB 1108710.3, filed 24 May 2011, the disclosures of which applications are incorporated herein by reference in their entireties.

This invention relates to a method and apparatus for use in multi-zone flow control applications, such as fracturing individual zones in oil and gas wells.

It is often desirable to selectively actuate downhole tools. However, communicating with the tools to cause actuation can be difficult in the harsh downhole environment. Systems such as RFID systems exist but these are complex, expensive and prone to failure.

During hydraulic fracturing of a multi-zone well, a series of tools are provided at each zone, and each downhole tool needs to be actuated in a sequential manner for fluid to be diverted to flow outwards to fracture the well. The most common approach to tool actuation is to use a plugging device, such as a ball or dart, which is dropped down a tubular positioned within the well bore. U.S. Pat. No. 7,552,779 (Murray) discloses a pump down dart system that interacts uniquely with the sliding member of a particular sliding sleeve. Once landed, the dart seals within the sliding sleeve. It also has an expendable plug section that reacts with well fluids and dissolves to allow production to commence. The darts remain within the wellbore unless milled out.

There are a number of limitations within this type of system. For instance, the darts remain in situ, limiting wellbore access to standard intervention tools. In addition, the disappearing plug section may take a significant amount of time to dissolve before oil or gas production can commence through the dart.

Also, as the sliding member interaction grooves are unique to the particular sliding sleeve, it is not likely that a single intervention tool or single configuration could be used to manipulate many sleeves open or closed in one trip, after the residual components of the dart have been removed.

A result of this type of system and with ball activated systems is that the sliding sleeve will always operate "down to open" for multi-zone facture operations.

According to the invention there is provided a downhole flow control apparatus comprising:

at least one tubular body locatable at a zone of a well, the tubular body having a longitudinal through bore and one or more transverse ports and a port covering device which, in use, is movable from a lower position in which the or each port is covered to an upper position in which the or each port is open; and at least one plugging device which is operable to travel downhole from the surface to locate within and seal the through bore of the tubular body, the plugging device including moving means to cause the port covering device to move from the lower position to the upper position thus allowing fluid communication between the through bore and the or each port.

The port covering device may comprise a sleeve member provided within the through bore of the tubular body. The sleeve member may include one or more slots which align with the or each port when the sleeve member is at the upper position.

The moving means may comprise a piston which is operable to cause the port covering device to move from the lower position to the upper position. The piston may be configured to move upwards when the plugging device is located within the through bore of the tubular body. The piston may be operable using downhole fluid pressure.

The plugging device may include retaining means for inhibiting movement of the moving means until a predetermined pressure has been reached. The retaining means may comprise one or more shearable screws.

The tubular body and plugging device may include co-operating locating means such that only a selected plugging device locates within a particular tubular body.

The co-operating locating means may comprise a unique arrangement and/or profile of one or more protrusions and recesses, the protrusions receivable within the recesses.

The or each plugging device may include an upper retrieval connector for coupling to a retrieval tool.

The or each plugging device may include a lower retrieval connector for coupling to a plugging device which is located further downhole.

The or each plugging device may include releasing means for releasing the plugging device from the tubular body. The releasing means may be configured such that the plugging device is released when the plugging device is moved downwards.

The apparatus may include a shutting device which is operable to travel downhole from the surface to cause the port covering device to move from the upper position to the lower position thus preventing fluid communication between the through bore and the or each port.

The shutting device may be configured to pass through the tubular body moving the port covering device as it passes.

The shutting device may be configured to pass through a plurality of tubular bodies arranged in series and to moving the port covering device of each tubular body as it passes.

An embodiment of the invention discloses apparatus for which pump down darts are used to locate within a unique profile within the main body of the sliding sleeve. Once anchored, the dart opens the sleeve upwardly in the opposite direction to that in which the dart travelled, allowing communication in that particular sliding sleeve. The darts are then recovered using standard intervention techniques in one or more trips. The darts are so designed so that they may be released downwards and latch further darts below. This allows many darts to be retrieved in a single trip.

As the darts are removed from the wellbore at the end of the operation, it is possible to resend all or any of the darts to communicate with particular zones, after closing all the sleeves with a single pump down shutting dart. This functionality may be required later in the life of the well to stimulate an individual zone.

Furthermore it is possible to use the pump down dart section in combination with either an isolation sleeve to seal off the sliding sleeve or a ported sleeve, fitted with chokes to limit flow from or into the particular zone.

A particular embodiment of the invention is described by way of example only with reference to the accompanying drawings in which.

Figure 1:
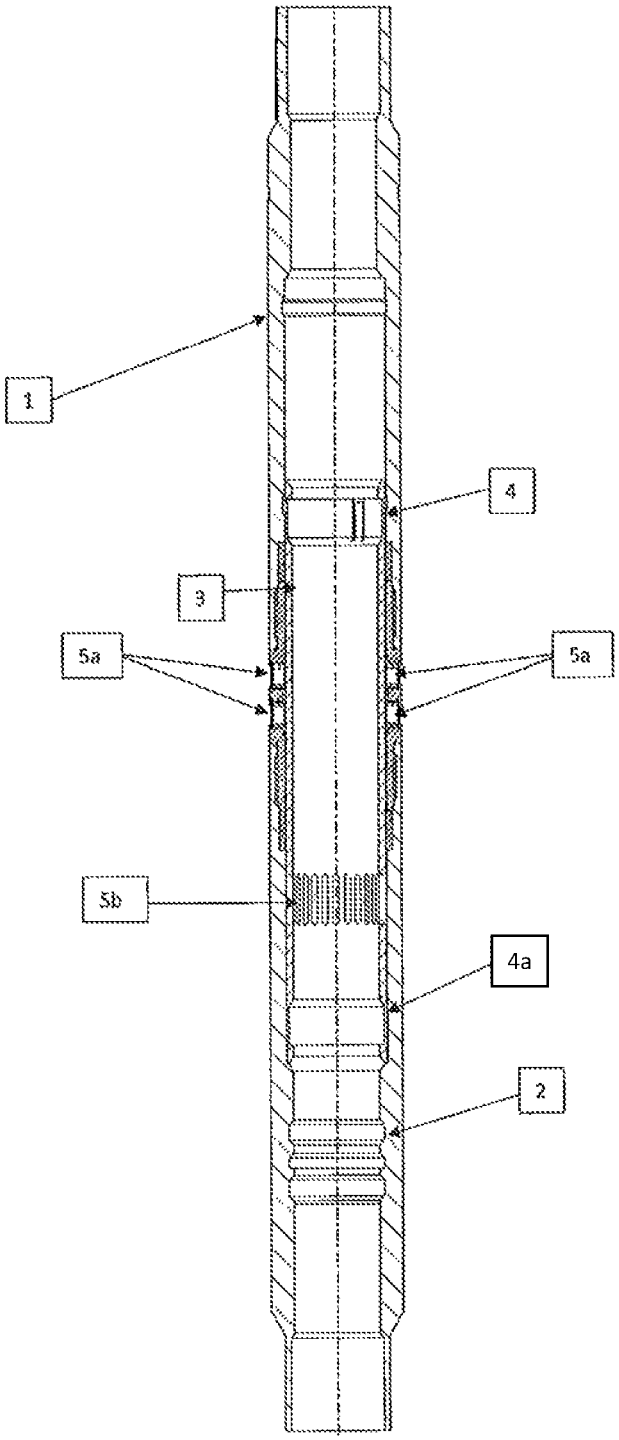
FIG. 1 is a sectional side view of a tubular body.

FIG. 1 shows an example "up-to-open" tubular body 1, where ports 5*a* on the outer body align with slots 5*b* on the port covering device or sliding member 3 when in the open position. The tubular body is configured with a unique locating profile 2 for the plugging device. Sliding member 3 has shifting grooves 4, which are identical and common across all sliding sleeves within the multi-zone system.

Figure 7:
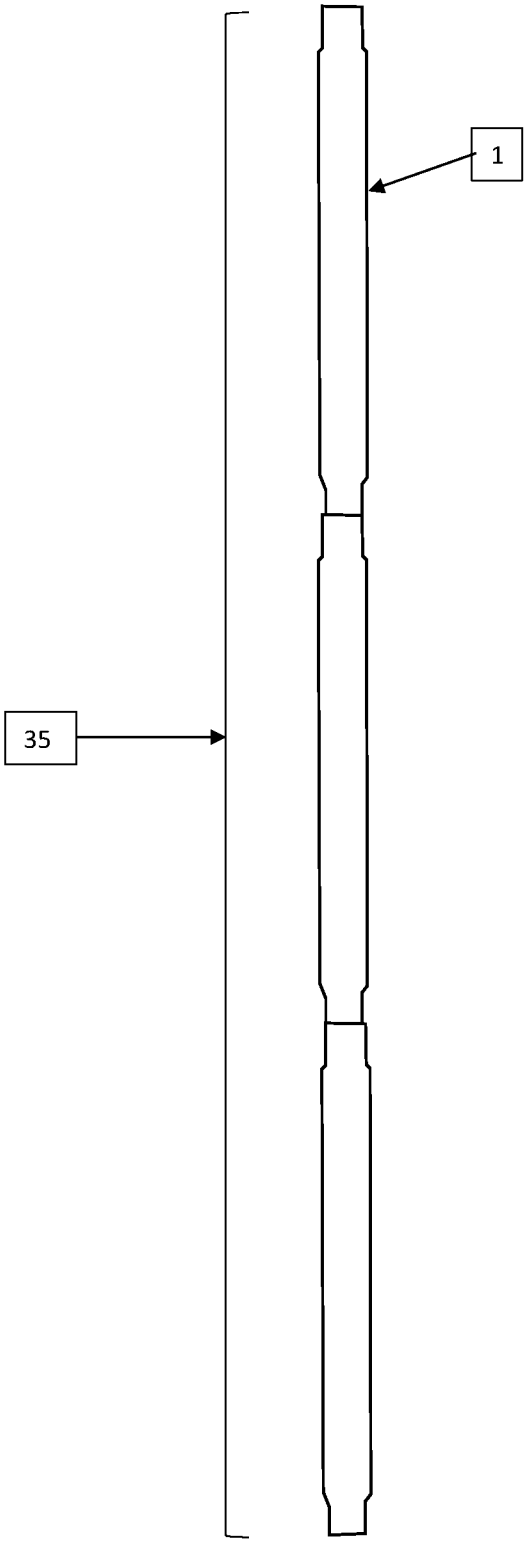

FIG. 7 is a sectional side view of a plurality of tubular bodies of FIG. 1.

Figure 2:
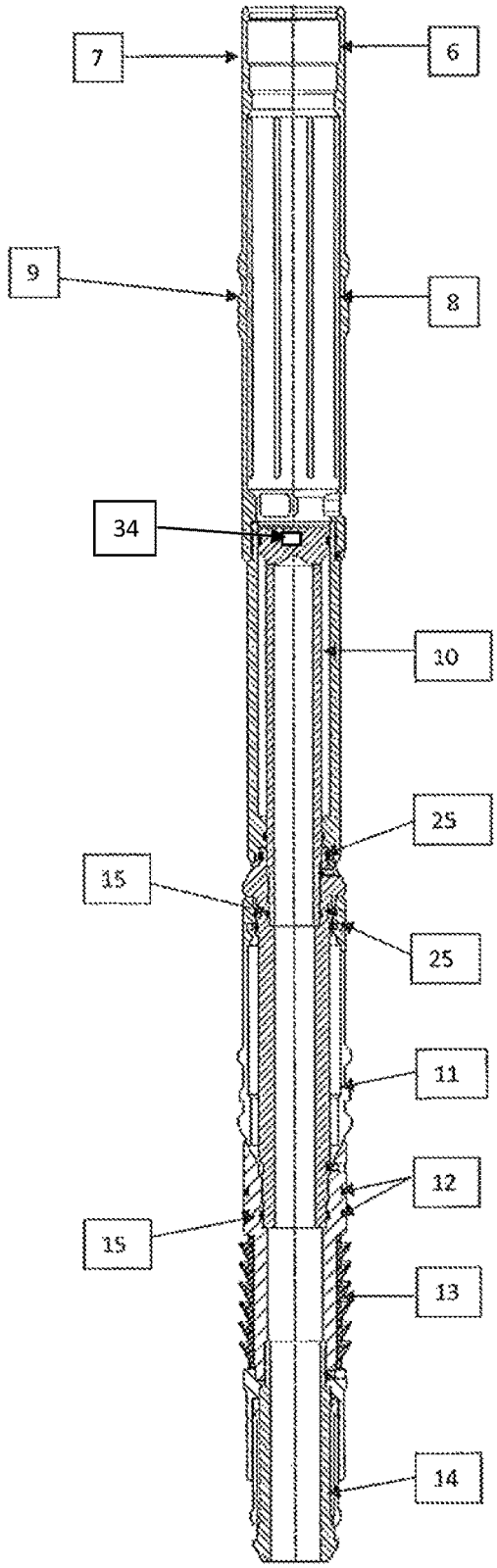
FIG. 2 is a sectional side view of a plugging device.

FIG. 2 shows the plugging device or opening dart tool 6, where a collapsible key 8 with sliding sleeve interaction profile 9 is preferably mounted above a piston arrangement 10, which is secured by shearable screws 25. A collet 11 has a unique locating profile, which allows the dart to be positioned in the correct sliding sleeve 1. A sealing element 13 preferably with collapsible fins is used to seal the dart within the wellbore. Fin type sealing elements are well known in the industry. To provide a redundant method of sealing seals 12 preferably o-rings are mounted on the dart. A catcher collet 14 is mounted at the bottom of the tool to latch into other darts having a latch profile 7 at the top.

Figure 3:
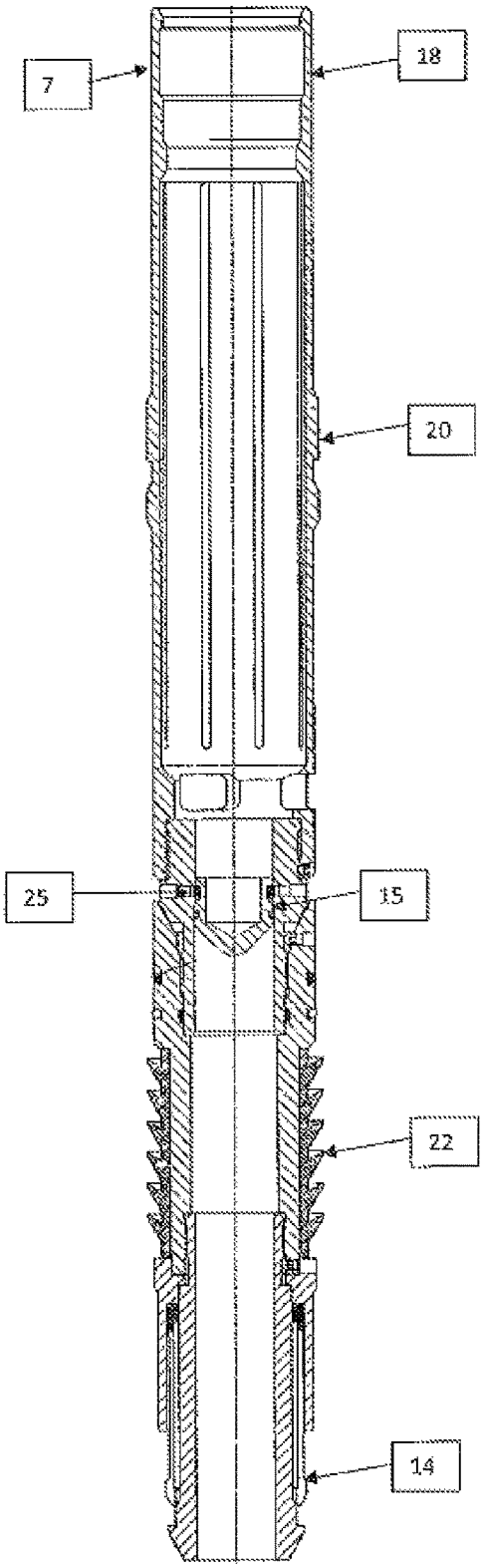
FIG. 3 is a sectional side view of a shutting device.

FIG. 3 shows a shutting device or pump down closing sleeve 18 which has a key 20 which is biased to close all sleeve members 3 by interacting with lower groove 4*a*. Wiper seal 22 provides a sealing means to allow the dart to be pumped down the wellbore. A catcher collet 14 allows the tool to latch other darts that may remain in the wellbore. Further sealing means 15, preferably o-rings complete the pressure integrity of the dart. A retrieval/latching groove 7 at the top of the tool, allows the dart to be retrieved using conventional intervention techniques.

Figure 4:
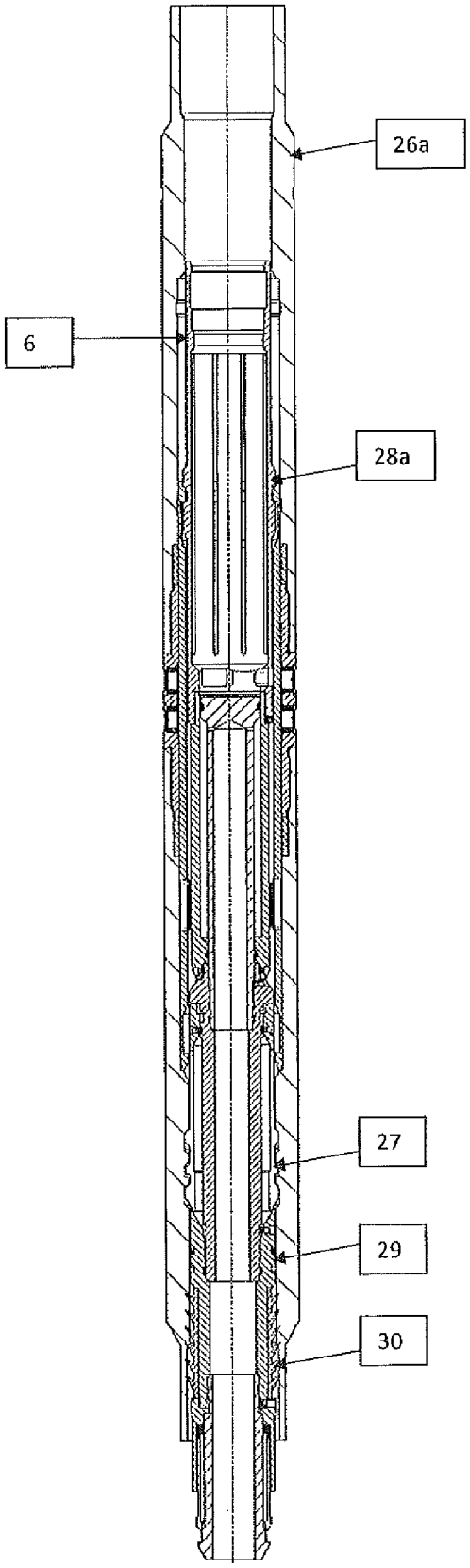
FIG. 4 is a sectional side view of the plugging device of FIG. 2 located within the tubular body of FIG. 1 and with the port covering device at the lower position.

FIG. 4 shows the opening dart 6 located within a closed sleeve 26*a*, by the dart locating at the unique groove 27. Sealing means is accomplished by the wiper 30 and o-rings 29. The opening key 8 interacts with the upper groove as shown at 28*a*.

Figure 5:
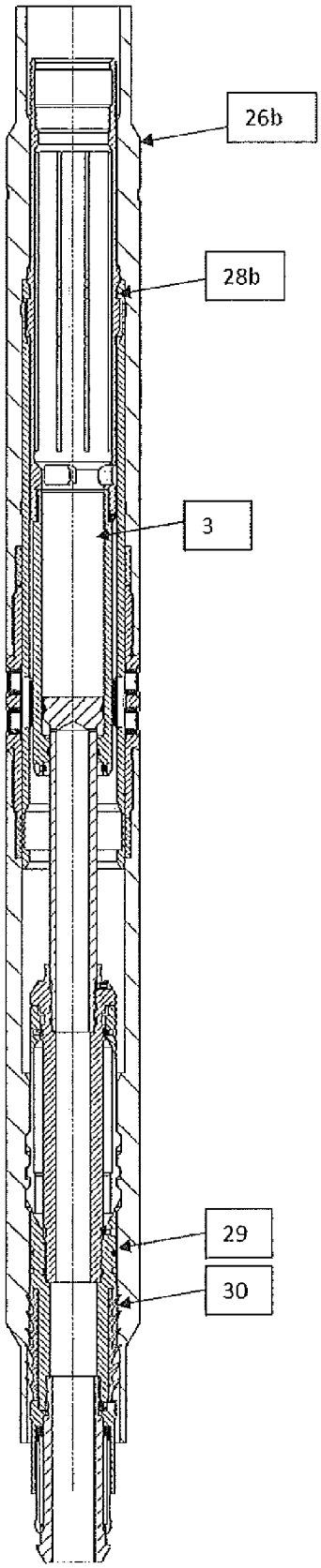
FIG. 5 is a sectional side view of the plugging device of FIG. 2 located within the tubular body of FIG. 1 and with the port covering device at the upper position.

FIG. 5 shows the opening dart 6 located within an open sleeve 26*b*, by the dart locating at the unique groove 27. Sealing means is accomplished by the wiper 30 and o-rings 29. The opening key 8 interacts with the upper groove as shown at 28*b*, where a pressure differential above the dart operates across the piston 10 to drive the opening key 8 upwards. As it has interacted with the groove 4 on the sleeve, the sleeve is opened.

Figure 6:
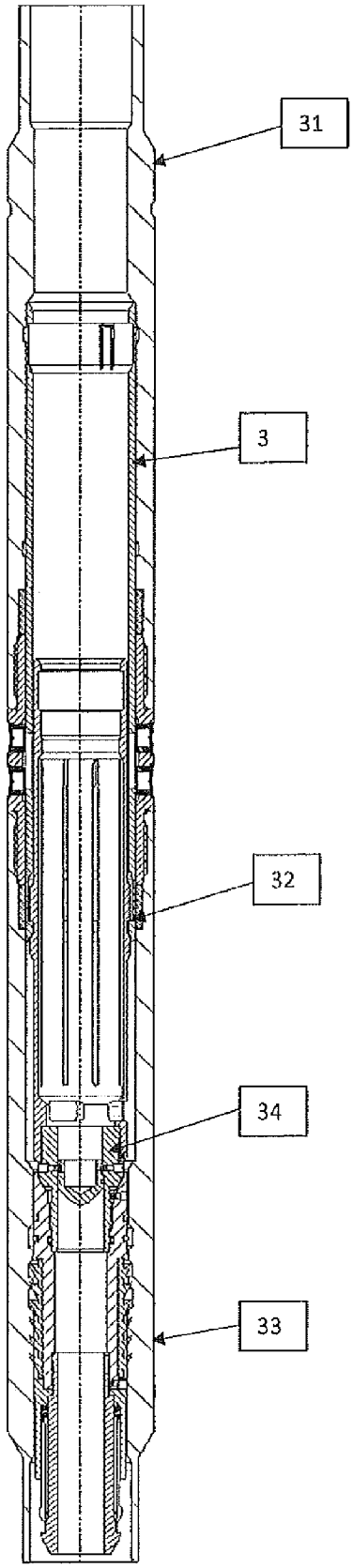
FIG. 6 is a sectional side view of the shutting device of FIG. 3 located within the tubular body of FIG. 1.

FIG. 6 shows the closing dart 18 located within an open sleeve 31. The dart seals within the sleeve at 33 and the latches the sliding member in the lower groove 4*a* as shown at 32. Thus it is demonstrable that the dart will interact with all sleeves within the wellbore, closing the sleeves. The key is designed so that it automatically releases from the groove 4 at the end on the travel of the sliding member. This auto-release feature is well understood in down hole tool design and operation. The dart then travels onwards to the next sleeve and repeats the operation.

FIG. 7 shows a plurality of tubular bodies 35 arranged in series through which the shutting device is configured to pass and to moving the port covering device of each tubular body 1 as the shutting device passes.

It is possible to mount a standard down-hole memory gauge or sensor 34 within the (opening or closing) dart to record various parameters, such as pressure and temperature, thus allowing the dart to perform logging activities as it travels. It may also record well parameters when located within the sliding sleeve.

It can be seen to those skilled in the art that various changes may be made to the features within this embodiment, without departing from the scope of the invention.

The invention claimed is:

1. A downhole flow control apparatus comprising: at least one tubular body locatable at a zone of a well, the tubular body having a longitudinal through bore and one or more transverse ports and a port covering device which, in use, is movable from a lower position in which the or each port is covered to an upper position in which the or each port is open, wherein the lower position is further downhole than the upper position when the apparatus is positioned downhole; and at least one plugging device which is operable to travel downhole from the surface to locate within and seal the through bore of the tubular body, the plugging device including moving means to cause the port covering device to move from the lower position to the upper position thus allowing fluid communication between the through bore and the or each port.

2. The apparatus as claimed in claim 1, wherein the port covering device comprises a sleeve member provided within the through bore of the tubular body.

3. The apparatus as claimed in claim 2, wherein the sleeve member includes one or more slots which align with the or each port when the sleeve member is at the upper position.

4. The apparatus as claimed in claim 1, wherein the moving means comprises a piston which is operable to cause the port covering device to move from the lower position to the upper position.

5. The apparatus as claimed in claim 4, wherein the piston is configured to move upwards when the plugging device is located within the through bore of the tubular body.

6. The apparatus as claimed in claim 4, wherein the piston is operable using downhole fluid pressure.

7. The apparatus as claimed in a claim 1, wherein the plugging device includes retaining means for inhibiting movement of the moving means until a predetermined pressure has been reached.

8. The apparatus as claimed in claim 7, wherein the retaining means comprises one or more shearable screws.

9. The apparatus as claimed in claim 1, wherein the tubular body and plugging device include co-operating locating means such that only a selected plugging device locates within a particular tubular body.

10. The apparatus as claimed in claim 9, wherein the co-operating locating means comprises a unique arrangement and/or profile of one or more protrusions and recesses, the protrusions receivable within the recesses.

11. The apparatus as claimed in claim 1, wherein the or each plugging device includes an upper retrieval connector.

12. The apparatus as claimed in any claim 1, wherein the or each plugging device includes a lower retrieval connector for coupling to a plugging device which is located further downhole.

13. The apparatus as claimed in claim 1, including a shutting device which is operable to travel downhole from the surface to cause the port covering device to move from the upper position to the lower position thus preventing fluid communication between the through bore and the or each port.

14. The apparatus as claimed in claim 13, wherein the shutting device is configured to pass through the tubular body moving the port covering device as the shutting device passes.

15. The apparatus as claimed in claim 14, wherein the at least one tubular body comprises a plurality of tubular devices arranged in series, wherein the shutting device is configured to pass through the plurality of tubular bodies and to moving the port covering device of each tubular body as the shutting device passes.

16. The apparatus as claimed in claim 1, wherein the plugging device includes one or more sensors for sensing at least one downhole parameter.

17. The apparatus as claimed in claim 16, wherein the plugging device includes a memory for storing at least one sensed parameter readings.

18. The apparatus as claimed in claim 17, wherein the plugging device is adapted to store sensed parameter readings as the plugging device travels downhole from the surface.

19. The apparatus as claimed in claim 17, wherein the plugging device is adapted to store sensed parameter readings when located within the port covering member.

* * * * *